United States Patent [19]

Inoue et al.

[11] 4,194,738

[45] Mar. 25, 1980

[54] FRAME OF A GAME RACKET

[75] Inventors: Mitsuhiro Inoue, Oyama; Yo Maeda, Yuki, both of Japan

[73] Assignee: Hitachi Chemical Company, Ltd., Tokyo, Japan

[21] Appl. No.: 919,220

[22] Filed: Jun. 26, 1978

[30] Foreign Application Priority Data

Jun. 30, 1977 [JP] Japan ..... 52-78668

[51] Int. Cl.[2] ..... A63B 49/10

[52] U.S. Cl. ..... 273/73 C

[58] Field of Search ..... 273/73 R, 73 C, 73 D, 273/73 F, DIG. 7

[56] References Cited

U.S. PATENT DOCUMENTS

| | | | |
|---|---|---|---|
| 3,647,211 | 3/1972 | Doessel et al. | 273/73 C |
| 3,690,658 | 9/1972 | Howe | 273/73 C |
| 3,755,037 | 8/1973 | Erwin et al. | 273/73 F X |
| 3,810,620 | 5/1974 | Decker et al. | 273/73 C X |
| 3,949,988 | 4/1976 | Staufer | 273/73 F |
| 3,998,457 | 12/1976 | Dempsey et al. | 273/73 F X |
| 4,042,238 | 8/1977 | Theriault | 273/73 C |
| 4,061,520 | 12/1977 | Cecka et al. | 273/73 F X |
| 4,082,274 | 4/1978 | Stevens | 273/73 C |

FOREIGN PATENT DOCUMENTS

| | | | |
|---|---|---|---|
| 208945 | 7/1957 | Australia | 273/DIG. 7 |
| 2270908 | 12/1975 | France | 273/73 C |

*Primary Examiner*—Richard J. Apley

*Attorney, Agent, or Firm*—Birch, Stewart, Kolasch & Birch

[57] ABSTRACT

The present invention is directed to a hollow frame for a game racket substantially constructed from a first fiber reinforced thermoplastic frame member which continuously provides outside peripheral portions of the tadpole shape of the frame including a head portion, a straight handle portion and a triangular throat portion which connects the head and handle portions, and a second fiber reinforced thermoplastic frame member which integrally provides the inside remaining portions, as viewed in the tadpole plan view, of the head, throat and handle portion, wherein the first and second frame members are joined together so as to form a hollow frame.

10 Claims, 7 Drawing Figures

FRAME OF A GAME RACKET

BACKGROUND OF THE INVENTION

The present invention relates to the frame of a game racket such as a tennis racket, badminton racket, or squash racket, and more particularly to such a frame of a game racket formed from fiber reinforced thermoplastic materials.

In the past the frame of a game racket was formed exclusively from wood. However, in order to obtain higher performance of the racket on the one hand, and on the other hand in order to avoid problems such as the difficulty in obtaining high quality wood material and the technical limits with regard to manufacturing wooden rackets of highly uniform quality, in recent years gradually increasing numbers of rackets have been made from other materials.

The materials which are now taking the place of wood to construct the frame of a game racket are metals and fiber reinforced plastics (FRP). Particularly, fiber reinforced thermoplastic (FRTP) is now commonly considered because with injection moulding it allows high productivity and high uniformity of quality. However, glass fiber reinforced thermoplastic which employs glass fibers as the reinforcing fiber material and is available at a relatively low cost, is much more flexible than wood, and therefore if a racket frame is made from this material so as to have the same rigidity as a wooden frame, it becomes too heavy to be suitable for practical use. On the other hand, carbon fiber reinforced thermoplastic employing carbon fibers as the reinforcing material has a relatively high rigidity due to the relatively high elastic coefficient of carbon fibers and is used in practice as the material for constructing the frame of a game racket. However carbon fiber reinforced thermoplastic is relatively expensive, and yet a racket frame made from this material is inferior to a wooden frame with regard to the relation between weight and rigidity.

The abovementioned problem with regard to lower rigidity relative to weight is due to the fact that it is difficult or almost impossible to construct the looped head portion of the racket frame as a hollow structure by moulding or particularly injection moulding of fiber reinforced thermoplastic. In view of this, various composite frame structures assembled from a plurality of members each having a shape available from moulding of fiber reinforced thermoplastic and having as a whole a hollow structure so as to increase its rigidity relative to its weight, have been proposed, as disclosed, for example, in U.S. Pat. Nos. 3,647,211; 3,690,658; 3,840,230; 3,889,951; 3,949,988 and 3,993,908. However, the composite racket frames proposed in these U.S. patents have relatively complicated structures requiring a relatively large number of parts and are believed to be relatively expensive.

SUMMARY OF THE INVENTION

The object of the present invention is to provide a racket frame having a composite structure assembled from injection moulded parts of fiber reinforced thermoplastic which is so simple as to be substantially constructed from two members and yet provides a highly rigid hollow structure with less material, thereby reducing the weight of the racket and also reducing the cost of material as well as the manufacturing cost.

In accordance with the present invention, the above object is accomplished by a frame of a game racket having the shape of a tadpole as viewed in a plan view and including a looped head portion for supporting strings, a straight handle portion and a triangular throat portion which connects said head portion and said handle portion, wherein said frame is constructed substantially from a first frame member which continuously provides outside peripheral portions, as viewed in said plan view, of said head, throat and handle portions, and a second frame member which integrally provides the inside remaining portions, as viewed in said plan view, of said head, throat and handle portions, said first and second frame members being so shaped as to leave an internal space in said frame when bonded or welded together to provide said frame.

The racket frame of the present invention having the structure as mentioned above may be formed from various kinds of fiber reinforced thermo-plastic materials, wherein the reinforcing fibers may be glass fibers, carbon fibers, high elasticity organic material fibers such as "Kevlar" fiber manufactured by DuPont company, etc., while on the other hand the thermoplastics may be polycarbonate, Nylon, polyacetal, polyethyleneterephthalate, polybutyleneterephthalate, AS, polypropylene, polyethylene, etc.

Said first and second frame members may be formed from different material and/or may be colored in different colors so as to provide various desired performances regarding rigidity versus weight and/or various desired designs. In the frame structure of the present invention, when the strings have been mounted in the usual manner as employed in the conventional wooden frame racket so as to penetrate the looped head portion repetitively from its inside to its outside and vice versa, said first frame member is firmly compressed around said second frame member in its portion forming the looped head portion and the firm assembly of the composite frame structure is automatically obtained. However, in order to obtain high rigidity of the assembled composite structure, it is of course desirable that said first and second frame members should be positively bonded together by employing proper bonding agents or solvents or they should be positively welded together by employing high frequency welding, supersonic welding, friction welding, hot gas welding, etc.. In this connection, in order to improve the firmness of the bonding or welding between the two frame members, it is desirable that the joining peripheral portions of at least one of the two frame members should be somewhat thickened so as to provide integral bead portions.

In order to reinforce the looped head portion of the frame against the tensile force exerted by the strings without substantially increasing the weight of the racket frame, it is desirable that reinforcing projections individually corresponding to the paths of the strings or a continuous rib or ribs corresponding to a plurality of paths of the strings should be formed in either said first frame member or said second frame member. These projections or rib or ribs may be formed as separate members so that they are bonded or welded to said first or second frame member. However, in order to simplify the assembling process of the racket frame and to improve firmness of the frame, it is desirable that these projections or rib or ribs should be formed as integral parts of said first or second frame member.

The internal space left in the hollow structure of the composite frame may be filled with a foamed plastic material such as hard urethane foam in order to improve the buckling strength of the racket frame and to supress vibration of the frame structure.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DESCRIPTION OF THE PREFERRED EMBODIMENT

Figure 1:
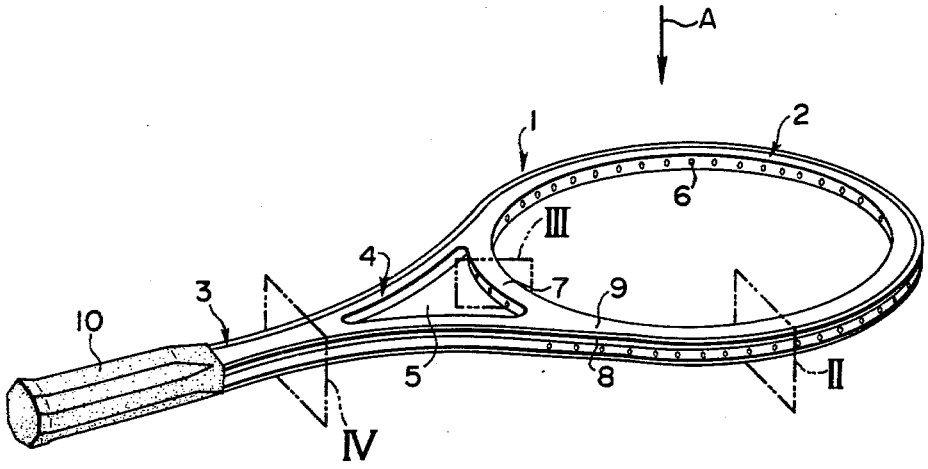
FIG. 1 is a perspective view showing an embodiment of the racket frame of the present invention.

Referring to FIG. 1 showing a frame of a tennis racket constructed in accordance with the present invention, the frame generally designated by 1 has the shape of a tadpole when viewed in a plan view taken in the direction of arrow A and includes a looped head portion 2 for supporting strings which are not yet mounted in the frame shown in FIG. 1, a straight handle portion 3 and a triangular throat portion 4 which connects the head portion 2 and the handle portion 3. In this embodiment, the throat portion is formed as an open throat portion having a triangular opening 5. The head portion 2 is formed with many small holes 6 for passing the strings not shown in the figure, these holes being formed in the same manner as in the conventional wooden frame so as to penetrate the entire thickness, as viewed in said plan view, of the frame forming the looped head portion. Some similar holes are also formed in the bridge piece designated by 7 which may be considered as a part of the head portion or as a part of the throat portion.

The frame 1 is constructed substantially from a first frame member 8 which continuously provides outside peripheral portions, as viewed in said plan view, of the head portion 2, the throat portion 4 and the handle portion 3, and a second frame member 9 which integrally provides the inside remaining portions, as viewed in said plan view, of the head portion 2, the throat portion 4 and the handle portion 3. In the embodiment shown in FIG. 1, the handle portion 3 further includes a grip member 10 such as a leather cover mounted over the handle frame constructed by the handle portions of said first and second frame members 8 and 9. As shown more clearly in FIGS. 2*a*, 2*b* and 4, the first frame member 8 has a cross section like a shallow channel including a bottom wall portion 8*a* and opposite bead-like side wall portions 8*b*, wherein a shouldered portion 8*c* is formed at the outside of each side wall portion 8*b*.

Figure 4:
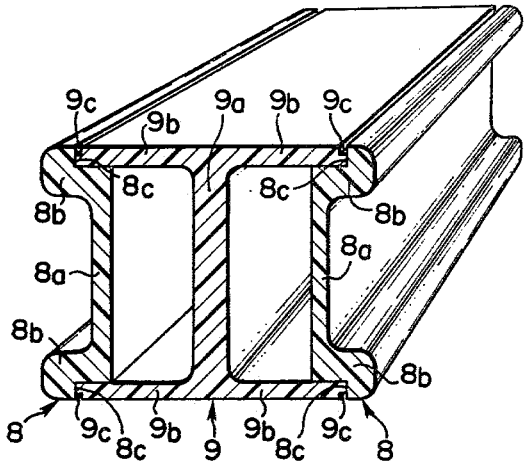
FIG. 4 is a perspective sectional view taken by the plane IV in FIG. 1.

On the other hand, the second frame member 9 has a cross-section like a relatively deep channel along its outer peripheral portion, as viewed in said plan view, including a bottom wall portion 9*a* and opposite side wall portions 9*b*. Particularly in the handle portion where two of the channel-shaped cross-sections are symmetrically joined together, the cross-section has the shape of an I beam. The first frame member 8 is mounted along the outside peripheral portion of the second frame member 9 in such a manner that the opposite shouldered portions 8*c* of the first frame member are seated by the outside peripheral edges of the opposite side wall portions 9*b* of the second frame member. In this connection, as shown in FIGS. 2*a*, 2*b* and 4, it is desirable that the outside peripheral edges of the side wall portions 9*b* of the second frame member should be formed with shoulder grooves 9*c* so as to form narrow channels along the joining borders of the first and second frame members, because such a narrow channel has the effect of disguising a small dimensional difference unavoidably involved between the widths of the first and second frame members 8 and 9 and provides an improved external appearance and design.

Figure 2A:
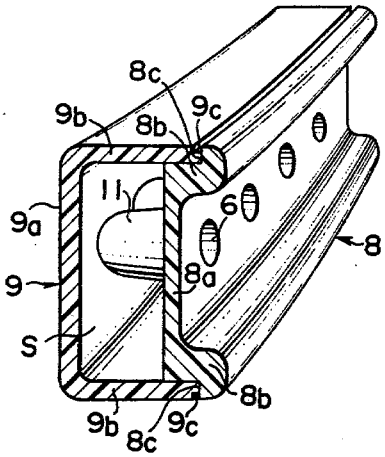
FIG. 2*a* is a perspective sectional view taken by the plane II in FIG. 1.

As shown in FIG. 2*a*, the first frame member 8 has a number of projections 11 formed integrally with the body of the frame member and spaced there along so as to correspond to the holes 6 for passing the strings not shown in the figure and so as to reinforce the peripheries of the holes 6. In this connection, the holes 6 may be formed in the process of forming the first frame member 8 by injection moulding or they may be formed by drilling after the first frame member has been moulded.

Figure 2B:
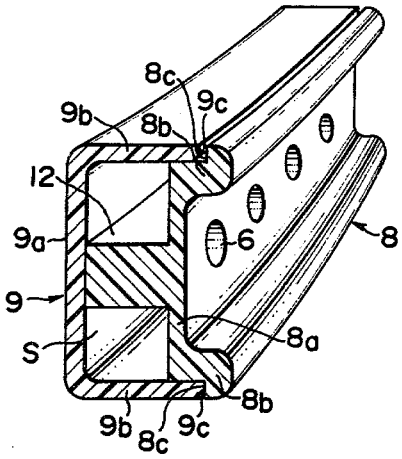
FIG. 2*b* is a view similar to FIG. 2*a* showing a modification of the reinforcing structure for the paths of the strings.

In the modification shown in FIG. 2*b*, the first frame member 8 is formed with a continuous rib portion 12 as a reinforcement around the holes 6. Also in this embodiment, the holes 6 may be formed when the frame member is moulded or they may be formed by drilling after the frame has been moulded. With regard to both projections 11 and the rib 12, they may alternatively be formed as a separate member or members, not integral with the first frame member 8, and may be bonded or welded to the bottom wall portion 8*a* of the frame member. However, in order to enhance the firmness of the racket frame it is more desirable that these projections 11 or the rib 12 should be formed integral with the frame member 8. Furthermore, as another modification, it will be considered that the projections 11 or the rib 12 is formed to be integral with or is bonded or welded to the second frame member 9. However, in view of the fact that the strings are supported more directly by the first frame member 8, it is more desirable that the reinforcing projections 11 or the rib 12 should be integral with or should be bonded or welded to the first frame member 8. In any event, it is desirable that the height of the projections 11 or the rib 12 should be just the same as the depth of the internal space S formed in the composite frame constructed from the first and second frame members 8 and 9 so that the tensile force exerted by the strings is effectively supported by the cooperation of the first and second frame members.

Figure 3:
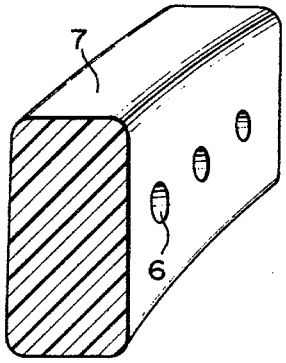
FIG. 3 is a perspective sectional view taken by the plane III in FIG. 1.
Figure 5:
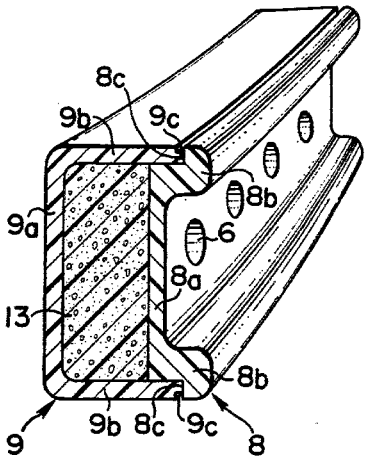
FIG. 5 is a view similar to FIGS. 2*a* and 2*b* showing a modification which incorporates a foamed plastic layer filling the internal space of the hollow frame.
Figure 6:
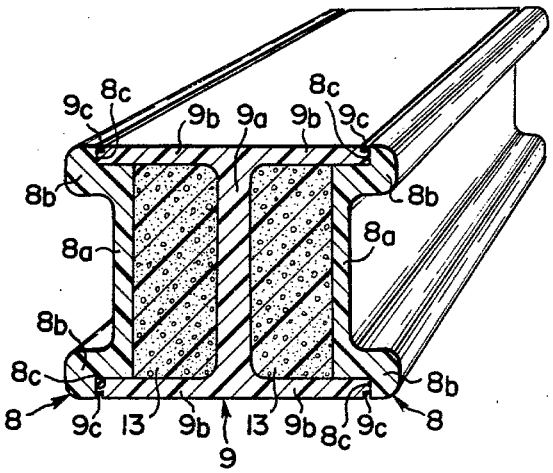
FIG. 6 is a view similar to FIG. 4 showing the same modification as shown in FIG. 5.

As shown in FIG. 3, the bridge piece 7 provided by the second frame member only has a solid structure. However, since this bridge piece 7 has a relatively small length, it does not substantially affect the total weight and rigidity of the racket frame. The holes 6 formed in this bridge piece 7 may also be formed in the process of moulding the second frame member or they may be formed by drilling after the second frame member has been moulded. FIGS. 5 and 6 are views similar to FIGS. 2*a* and 2*b* and FIG. 4, respectively, showing a modification which is to fill the internal space S formed between the first and second frame members 8 and 9 with a filler 13 of a foamed plastic such as hard polyurethane foam. The hard polyurethane foam can be formed by pouring liquid polyurethane resin into the internal space S of the assembled frame and by making the liquid polyurethane resin foam in the internal space S. In this case, it is desirable that the holes 6 should be drilled in the end after the composite frame including the foamed plastic filler has been completed.

Table 1 shows comparisons of performances with respect to various kinds of racket frames.

Table 1

| | Weight (gm) | Distance from grip end of center of gravity (mm) | Flexure (by JIS S7009) (mm) |
|---|---|---|---|
| Glass F.R.T.P. Solid head portion | 400 | 370 | 12.5 |
| Carbon F.R.T.P. Solid head portion | 345 | 350 | 7.5 |
| Embodiment with no filling layer* | 320 | 330 | 7.5 |
| Embodiment with foamed filling layer** | 330 | 335 | 7.4 |
| Wooden frame | 320 | 330 | 7.5 |

*Formed from polycarbonate resin reinforced by 40% of short glass fibers.
**Formed from polycarbonate resin reinforced by 40% of short glass fibers and filled with foamed polyurethane resin.

From Table 1 it will be appreciated that the racket frame obtained by the present invention has substantially the same performance as a wooden frame and is much improved when compared with a solid frame racket formed from glass fiber reinforced thermoplastic or even when compared with a solid racket frame formed from carbon fiber reinforced thermoplastic.

Although the invention has been shown and described with respect to some preferred embodiments thereof, it should be understood by those skilled in the art that various changes and omissions of the form and detail thereof may be made therein without departing from the scope of the invention.

We claim:

1. A frame of a game racket including a looped head portion for supporting strings, a handle portion, and a bridge piece which forms one side of a triangular throat portion which connects said head portion and said handle portion comprising:

a continuous first frame member extending along a first side of said handle portion around the looped head portion and returning along a second side of said handle portion;

a second frame member extending around the inside portion of said looped head portion and being closed by said bridge piece, said bridge piece being solid and formed integrally with said second frame member;

two leg members being formed integrally with said second frame member and coextending with said first frame member to form said handle;

said second frame member being channel shaped and including a bottom wall and an open end, said open end thereof facing outwardly around said looped head portion;

said leg members being channel shaped, and including a bottom wall and an open end with said open end facing outwardly and extending from said looped head portion from adjacent each side of said bridge piece thereby forming said triangular throat portion therebetween, said bottom wall of each of said leg members being joined together into a I-shaped adjacent said triangular throat portion and extending downwardly to form an interior support of said handle portion;

said continuous first frame member extending around the outside peripheral portions to close said open end of the channel of said second frame member and said leg members and forming an internal space therebetween.

2. The frame of claim 1, wherein said second frame member includes outside peripheral edges being individually formed with narrow shoulder edges which form narrow external grooves along the joining boundaries of said first and second frame members.

3. The frame of claim 1 or 2, wherein said first frame member is formed with a number of projections which traverse said internal space, said frame being formed with a number of holes which penetrate said frame through said projections for passing strings therethrough.

4. The frame of claim 1 or 2, wherein said first frame member is formed with a rib which traverses said internal space, said frame being formed with a number of holes which penetrate said frame through said rib for passing strings therethrough.

5. The frame of claim 1 or 2, wherein said internal space is filled with foamed plastic.

6. The frame of claim 5 wherein said foamed plastic is hard polyurethane foam.

7. The frame of claim 1 or 2, wherein said first and second frame members are formed from glass fiber reinforced polycarbonate resin.

8. The frame of claim 1 or 2, wherein said first and second frame members are formed from glass fiber reinforced Nylon.

9. The frame of claim 1, wherein said first frame member is a relatively shallow channel in cross section and said second frame member is a relatively deep channel in cross section, said relatively shallow channel and said relatively deep channel facing outwardly around said looped head portion and said leg members.

10. The frame of claim 9, wherein said first frame member includes shoulder portions disposed on an outer peripheral edge of said relatively shallow channel and said shoulder portions being seated on an outer peripheral edge of said relatively deep channel.

* * * * *